US007500654B2

(12) United States Patent
Rosaen

(10) Patent No.: US 7,500,654 B2
(45) Date of Patent: Mar. 10, 2009

(54) FENCING SYSTEM

(76) Inventor: Lars Rosaen, 46980 N. Territorial Rd., Plymouth, MI (US) 48170

( * ) Notice: Subject to any disclaimer, the term of this patent is extended or adjusted under 35 U.S.C. 154(b) by 0 days.

(21) Appl. No.: 10/839,085

(22) Filed: May 5, 2004

(65) Prior Publication Data

US 2004/0206947 A1 Oct. 21, 2004

Related U.S. Application Data

(63) Continuation-in-part of application No. 10/156,546, filed on May 28, 2002, now Pat. No. 6,866,251.

(51) Int. Cl.
*E04H 17/00* (2006.01)

(52) U.S. Cl. ..... 256/65.14; 256/59; 256/65.01; 33/373; 248/545

(58) Field of Classification Search ..... 256/25, 256/26, 32, 47, 53, 57, 65.01, 65.02, 70, 256/71, 73; 52/50, 153, 155, 165, 298; 248/156, 248/515, 530, 545; 33/367, 372, 373, 374, 33/379, 382

See application file for complete search history.

(56) References Cited

U.S. PATENT DOCUMENTS

| | | | | | |
|---|---|---|---|---|---|
| 1,066,223 | A | * | 7/1913 | Rendchen | 165/163 |
| 1,826,182 | A | * | 10/1931 | Lee | 256/57 |
| 1,951,282 | A | * | 3/1934 | Hise et al. | 256/58 |
| 2,184,449 | A | * | 12/1939 | Bell | 33/382 |
| 3,230,626 | A | * | 1/1966 | Berrien | 33/293 |
| 3,238,678 | A | * | 3/1966 | Barnett | 52/155 |
| 3,428,108 | A | * | 2/1969 | Singer | 52/239 |
| 3,469,822 | A | * | 9/1969 | O'Brein | 256/25 |
| 3,515,373 | A | * | 6/1970 | Abbe | 256/32 |
| 3,579,908 | A | * | 5/1971 | Morgan | 47/45 |
| 4,249,715 | A | * | 2/1981 | Repp | 248/545 |
| 4,279,104 | A | * | 7/1981 | Classen | 52/38 |
| 4,836,143 | A | * | 6/1989 | Shadbolt, Jr. | 119/514 |
| 4,896,651 | A | * | 1/1990 | Kott, Jr. | 248/156 |
| 4,976,040 | A | * | 12/1990 | Mish et al. | 33/372 |
| 5,082,231 | A | * | 1/1992 | Knowles | 248/545 |
| 5,207,175 | A | * | 5/1993 | Andonian | 116/209 |
| 5,253,425 | A | * | 10/1993 | Wozniak | 33/373 |
| 5,255,443 | A | * | 10/1993 | Schmidt | 33/373 |

(Continued)

FOREIGN PATENT DOCUMENTS

| | | | |
|---|---|---|---|
| DE | 31 12 129 A1 | 12/1982 | 403/54 |

(Continued)

OTHER PUBLICATIONS

Printouts from "Quickpost Website" http://www.challengefencing.com/steelsupport1.html, 4 pages, undated.

*Primary Examiner*—Robert J Sandy
*Assistant Examiner*—Ruth C Rodriguez
(74) *Attorney, Agent, or Firm*—Gifford, Krass, Sprinkle, Anderson & Citkowski, P.C.

(57) ABSTRACT

A fencing system includes an anchor that is insertable into the ground and a pole having an end that is mounted over the anchor such that the pole is supported by the anchor. A fastener is located on the pole and is used to secure fencing material to the pole.

23 Claims, 6 Drawing Sheets

U.S. PATENT DOCUMENTS 5,255,898 A * 10/1993 Cacicedo ..... 256/47
5,309,645 A * 5/1994 Hoffmeyer ..... 33/367
5,504,397 A * 4/1996 Chien ..... 315/185 S
5,509,210 A * 4/1996 Murphy ..... 33/382
5,676,351 A * 10/1997 Speece et al. ..... 256/54
5,709,366 A * 1/1998 Speece ..... 248/530
5,722,205 A * 3/1998 Gannaway ..... 52/155
5,735,508 A * 4/1998 Lancour et al. ..... 256/57
5,951,415 A * 9/1999 Gates et al. ..... 473/478
6,029,359 A * 2/2000 Szumer ..... 33/373
6,070,859 A * 6/2000 Damon et al. ..... 256/1
6,076,448 A * 6/2000 Rexroad ..... 87/12
D429,171 S * 8/2000 Bernal Vazquez et al. .... D10/69
6,142,453 A * 11/2000 Martin ..... 256/65.05
6,202,368 B1 * 3/2001 Wallace, III ..... 52/157
6,202,369 B1 * 3/2001 Partee et al. ..... 52/165
6,311,428 B1 * 11/2001 Marino et al. ..... 47/46
6,412,236 B1 * 7/2002 Johnson ..... 52/157
6,439,744 B1 * 8/2002 Chanslor ..... 362/249
6,461,084 B1 * 10/2002 Stuart ..... 52/165
6,467,756 B1 * 10/2002 Elsasser ..... 256/65.14
6,866,251 B2 * 3/2005 Rosaen ..... 256/25

FOREIGN PATENT DOCUMENTS

EP 0 62 690 A1 4/1981 ..... 403/54
EP 0 280 266 A1 2/1987 ..... 403/54

* cited by examiner

FENCING SYSTEM

RELATED APPLICATION

This application is a continuation-in-part of U.S. patent application Ser. No. 10/156,546 filed May 28, 2002.

BACKGROUND OF THE INVENTION

1. Field of the Invention

The present invention is directed to a fencing system. More particularly, the present invention is directed to a lightweight fencing system that can be easily and quickly constructed or disassembled.

2. Reference to Related Art

It is often said that good fences make for good neighbors. Therefore, it should be no surprise that a number of fencing systems are readily available on the open market. One of the most popular systems is the traditional chain link fence. Other well-known systems include the privacy fence, which is well known in suburban America, and the barbed wire fence, which has particular utility in keeping livestock in and trespassers out.

Much of the fencing that is encountered in daily life is intended to be installed as part of a permanent structure. The materials used are manufactured from heavy, durable materials that are designed to withstand punishment and last for a significant period of time. One example of this type of construction is traditional chain link fence posts that are designed to be driven far into the ground and may even be supported in a concrete foundation. However, on occasion it may become necessary to construct only a temporary fence, rather than a permanent structure. For example, a temporary fence structure would permit the user to protect gardens from rabbits during the growing season or a damaged golf green from trespassers while the green undergoes repair. In these and other instances, the use of traditional heavy (and permanent) fencing materials is not required or desired. Therefore, it would be advantageous to have a lightweight fencing system that may be easily constructed and disassembled without having to resort to elaborate and time-consuming construction techniques.

U.S. Pat. No. 5,857,664 discloses a fence system that includes tubular plastic posts that are positioned over an anchor assembly. Tubular plastic rails that are connected by plastic couplings connect the posts.

U.S. Pat. No. 5,758,868 discloses a slit fence. The slit fence includes a plastic post and a number of post units that are positioned over the posts. Each post unit is adapted to receive a stabilizing unit for use in securing fencing material to the post unit and thus the post.

SUMMARY OF THE INVENTION

A fencing system includes an anchor that is insertable into the ground and a pole having an end that is mounted over and around the anchor such that the pole is supported by the anchor. A fastener is located on the pole and is used to secure fencing material to the pole. The anchor is constructed of aluminum and has four longitudinally extending flange portions. The pole is also constructed of aluminum and is slidably mounted over and around the anchor such that it is supported in a substantially vertical position relative to the ground. The fastener on the pole is a mounting clip such as an inverted V-clip.

A gate constructed of a pair of side members and a pair of cross members that are joined by elbow joint units may be attached to a pole by hinge members to provide a user with access into the area enclosed by the fencing system.

The fencing material is preferably a sheet or roll of polymeric mesh material. However, other materials such as metal wire fencing, rope or individual strands of material may also be used as fencing material.

In another embodiment, the anchor is constructed to include a stake portion and a pole support portion. A base member is removably secured to the anchor and ensures that a user does not drive the stake portion of the anchor too far into the ground. The base member also serves to support the pole member a consistent position/height such that a user may easy dig around the pole/anchor as a means of burying the fencing material in the ground.

In a further embodiment a mallet and pole level are used to secure the anchors and poles in the ground in a vertical (or other preferred) orientation. A sprinkler assembly is provided that is removably mounted to a pole. The further embodiment includes an alternative gate assembly. The gate assembly includes a connector lock and a barrier. The connector lock is operable to releasably connect a gate pole with a second pole. The barrier is positioned at the base of the gate assembly and provides effective protection against animals that might otherwise burrow or dig under the gate.

BRIEF DESCRIPTION OF THE DRAWINGS

A clear understanding of the present invention will be had upon reference to the accompanying drawings wherein like reference numerals refer to like parts throughout and wherein.

DETAILED DESCRIPTION

Figure 1:
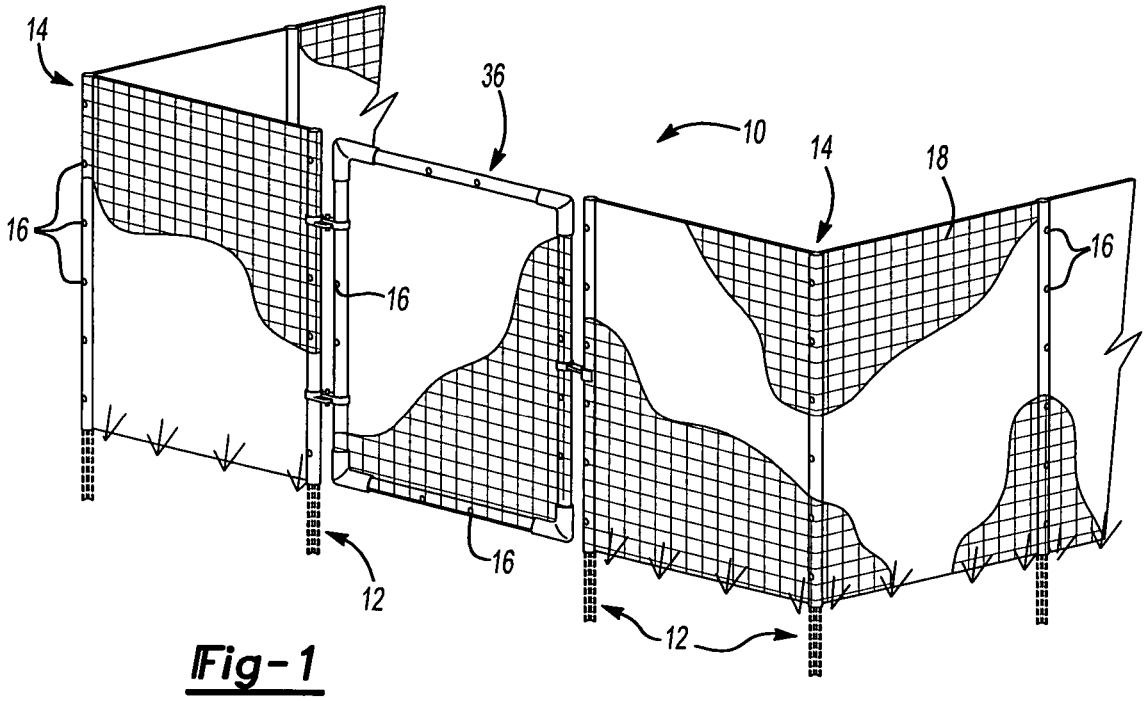
FIG. 1 is a perspective view of a preferred embodiment of a fencing system constructed in accordance with the present invention.

Referring now to FIG. 1, there is shown a fencing system 10 constructed in accordance with a preferred embodiment of the present invention. Preferably, the fencing system 10 includes an anchor 12 that is designed to be embedded at least partially into the ground and a pole 14 that is mounted over and supported by the anchor 12. A fastener 16 is located on the pole 14 and used for a securing fencing material 18 to the pole 14.

Figure 2:
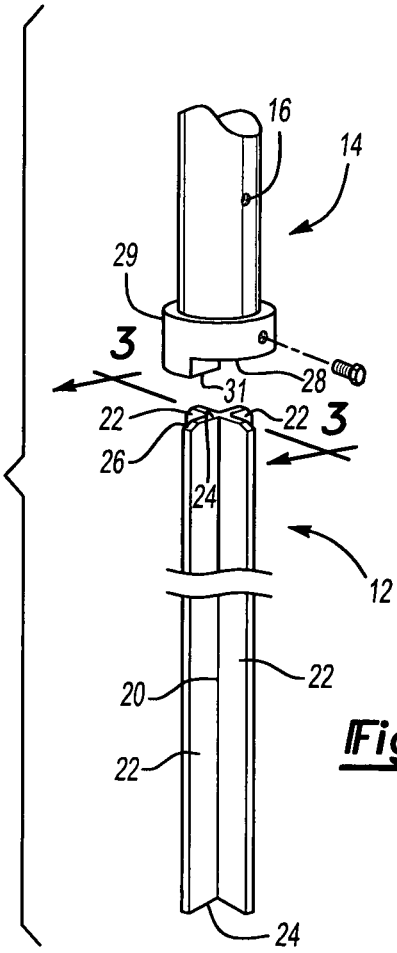
FIG. 2 is a perspective view of the anchor and pole of the fencing system shown in FIG. 1.
Figure 3:
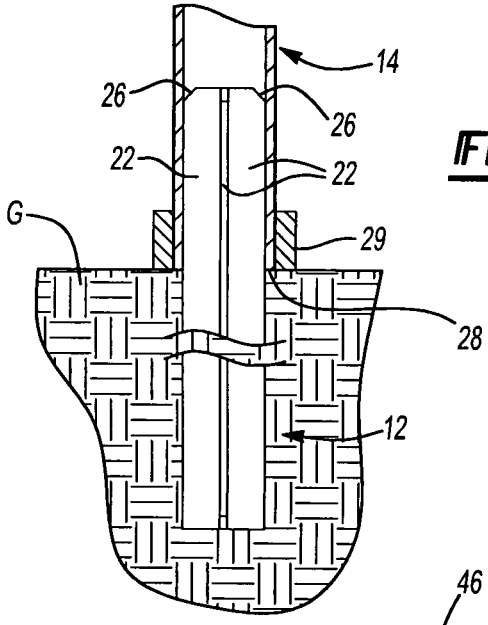
FIG. 3 is a side environmental view showing the anchor partially embedded in the ground and the pole.

Referring now to FIGS. 1-3, the anchor 12 of the present invention is preferably constructed of aluminum or some other lightweight metal or metal alloy. However, it will be appreciated that the anchor 12 may also be a polymeric rod (e.g., a hardened plastic) or bar that is capable of being hammered or otherwise forcibly embedded (at least partially) into the ground "G" (see FIG. 3).

As seen in FIG. 2, the anchor 12 includes a body 20 having a cross or "X" shape such that the anchor 12 has four longitudinally extending flange portions 22. The anchor 12 has a pair of ends 24 that are flat (being perpendicular to the flange portions 22), which assists a user in striking the anchor 12 with a hammer or like device (not shown). Alternatively, one or both of the ends 24 of each of the flange portions 22 may be cropped, as at 26, proximate the ends 24 of the anchor 12 at a 45° angle relative to the ends 24. As a still further alternative, the user may fit a removable adapter (not shown) having an end face complementary to the shape of the anchor 12 over an end 24 of the anchor to directly absorb the impact of a hammer strike.

Still referring to FIGS. 1-3, the pole 14 is an elongated tubular pole 14 having a pair of open ends 28, 29. The pole 14 is preferably constructed of aluminum or some other lightweight metal or metal alloy. However, it will be appreciated that the pole 14 may also be constructed of a polymeric material, such as plastic. As best shown in FIG. 3, the open end 28 of the pole 14 is slidably mounted over and around anchor 12 as the anchor 12 extends (at least partially) from the ground "G" (see FIG. 3). The anchor 12 and pole 14 are arranged such that the pole 14 is supported in a substantially vertical position relative to the ground "G". Although, it will be appreciated that the anchor 12 and pole 14 may be arranged such that the pole 14 is supported on the anchor 12 at an angle that is less than 90° to the ground "G". A stop collar 29 having a wedge portion 31 is mounted on the open end 28 of the pole. The wedge portion 31 projects into an interior of the stop collar 29 and is designed to be slidably positioned between a pair of flange portions 22 as the pole 14 is mounted over the anchor 12. When installed, the stop collar 29 prohibits the rotation of the pole 14 around the anchor 12.

Figure 5:
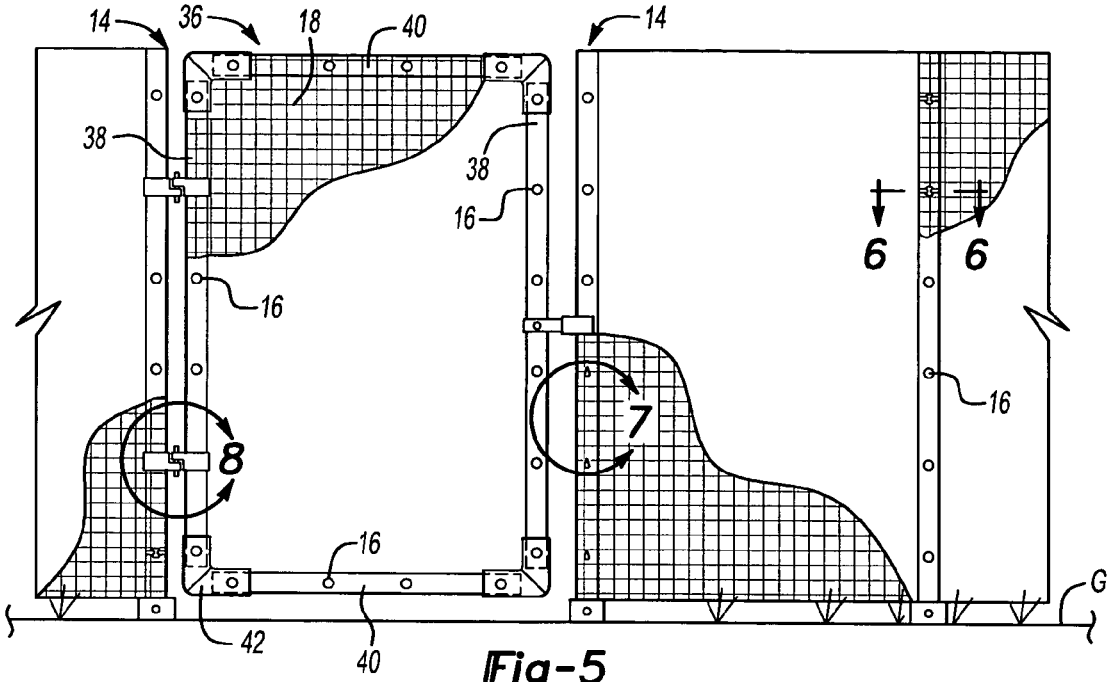
FIG. 5 is a front view of the fence and gate constructed in accordance with the present invention.
Figure 6:
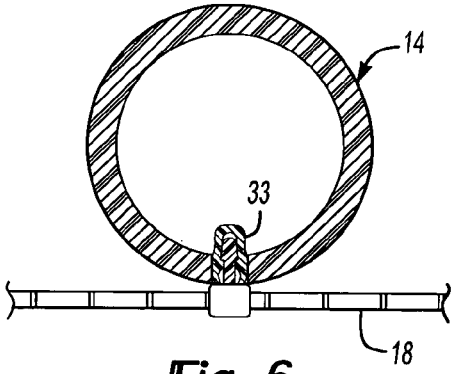
FIG. 6 is a perspective view showing a pole and mounting clip.
Figure 7B:
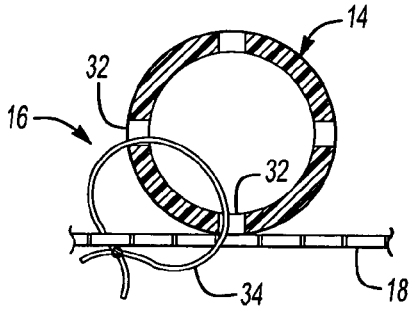
FIG. 7B is a top cutaway view of a pole showing a further alternative means for connecting the fencing material.

Referring now to FIGS. 5-7B, a fastener 16 is positioned on the pole 14 of the present invention. The fastener 16 is preferably a mounting clip 30 such as a looped cable clip 33. However, the fastener 16 may also be a separate clip element (e.g., a hook) that is glued or otherwise attached to the pole 14 or, as seen in FIG. 7A an inverted V-clip that is cut into the pole 14. As shown in FIG. 7B, the fasteners 16 of the pole 14 may alternatively include two or more holes 32 through which passes a tie member 34 (e.g., a string, twist tie, etc.). The tie member 34 is passed through the holes 32 and the fence material 18 and then knotted or tightened to secure the fencing material 18 in place.

Figure 4:
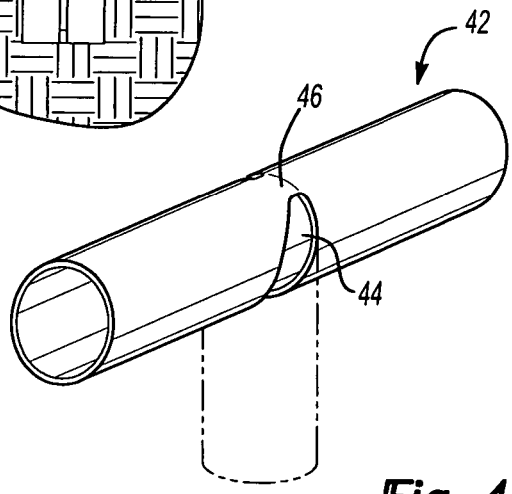
FIG. 4 is a perspective view of an elbow joint unit for a gate.

Referring now to FIGS. 1, 4 and 7A-9, there is shown a gate assembly 36 for use with the fencing system 10 of the present invention. The gate assembly 36 is constructed from a pair of side members 38 and a pair of cross members 40 that are connected by elbow joint units 42 (see FIG. 4). The side members 38 and cross members 40 are constructed in a manner similar to the poles 14. Therefore, the side member 38 and cross members 40 include fasteners 16 along their respective lengths. As seen in FIGS. 4 and 5, when the pole 14 is constructed of a plastic, it is preferable that the elbow joint unit 42 of the gate assembly 36 is a plastic tubular structure having a cutout portion 44 and hinge 46 (see FIG. 4). When the pole 14 is constructed of aluminum (or like material), the elbow joint unit 42 is preferably constructed from two tubes of aluminum or other lightweight material by cutting and welding the ends of the tubes as is well known in the art. The elbow joint units 42 are secured to the side members 38 and cross members 40 by plastic rivets (not shown). The elbow joint units 42 can also be frictionally mounted to the side members 38 and cross members 40.

Figure 8:
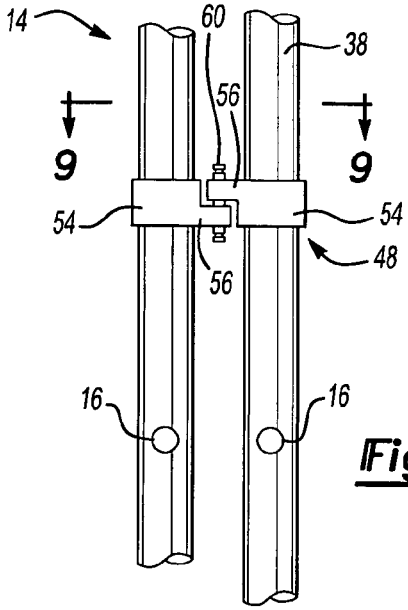
FIG. 8 is a side view of a hinge for a gate assembly of the present invention.
Figure 9:
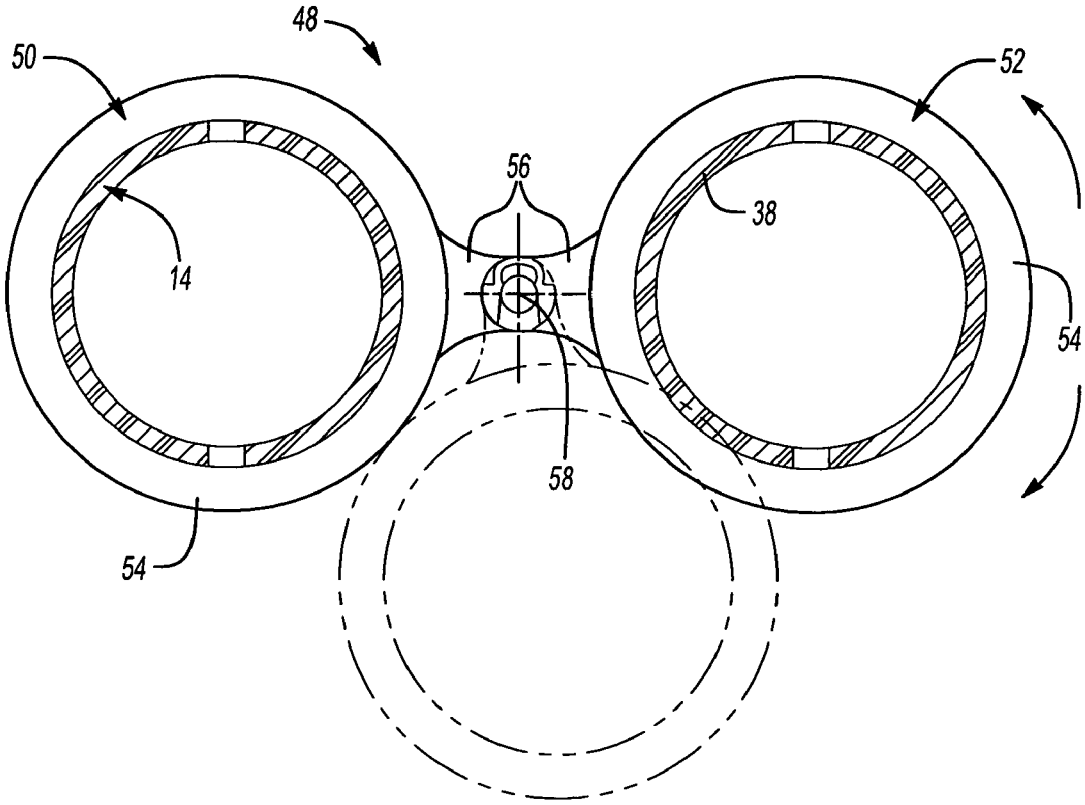
FIG. 9 is a top planar view of a hinge for a gate assembly of the present invention.

Referring now to FIGS. 5, 8 and 9, there is shown a gate hinge 48 for use with the gate assembly 36 of the present invention. The gate hinge 48 includes a first hinge member 50 that is secured to a pole 14 and a second hinge member 52 that is secured to a side member 38 of the gate assembly 36. The hinge members 50, 52 are identical to each other but are arranged in an inverted fashion with respect to each other on the pole 14 and side member 38. The hinge members 50, 52 each include a tubular portion 54 that is securable about the pole 14 or side member 38 and an arm 56 that extends from the tubular portion 54 of the hinge members 50, 52. The arm 56 defines a hinge aperture 58 through which is passed a pin 60 (see FIG. 8) or similar type of structure to movably connect the first 50 and second 52 hinge members.

Figure 7A:
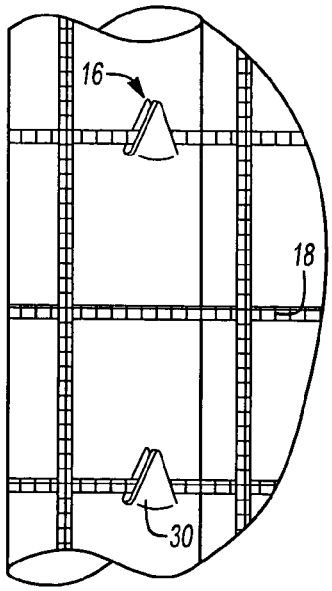
FIG. 7A perspective view of a pole showing an alternative means for connecting the fencing material.

The fencing material 18 of the present invention is preferably a sheet or roll of a polymeric mesh material. However, it will be appreciated that metal wire fencing (e.g., chicken wire), rope or individual strands of material (e.g., fishing line) may also be used in connection with the present invention. As seen in FIGS. 6, 7A and 7B, the fencing material 18 is secured to the pole 14 by use of a fastener 16.

Figure 10:
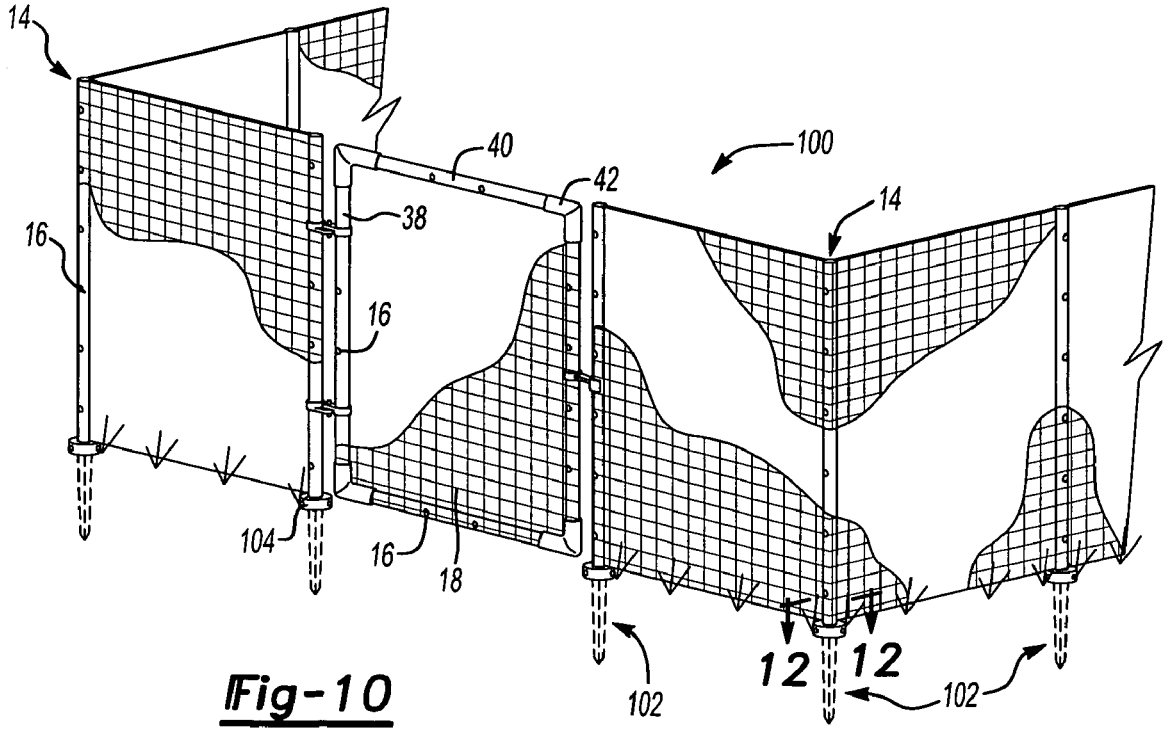
FIG. 10 is a perspective view of a fencing system constructed in accordance with an alternative embodiment of the present invention.

Referring now to FIG. 10, there is shown an alternative embodiment of the fencing system 100 constructed in accordance with the present invention. The alternative embodiment of the fencing system 100 includes an anchor 102 having an adjustable base member 104. A pole 14 is mounted over and supported on the anchor 102 and is seated on the base member 104. A fastener 16 is positioned on the pole 14 and is used for securing fencing material 18.

Figure 11:
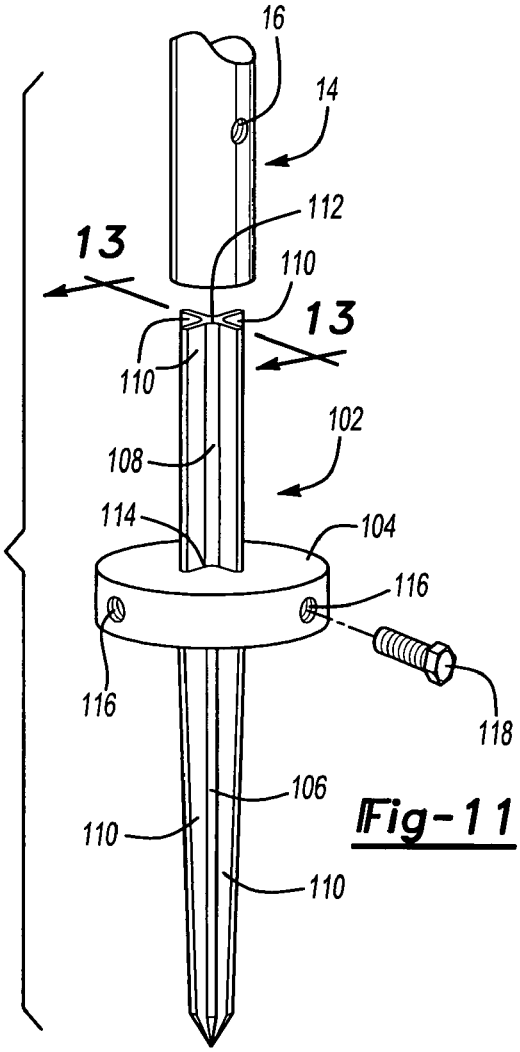
FIG. 11 is an exploded perspective view of an anchor constructed in accordance with the alternative embodiment.
Figure 12:
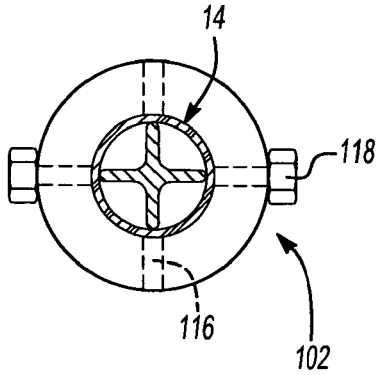
FIG. 12 is a top planar view taken along line 12-12 of FIG. 10.
Figure 13:
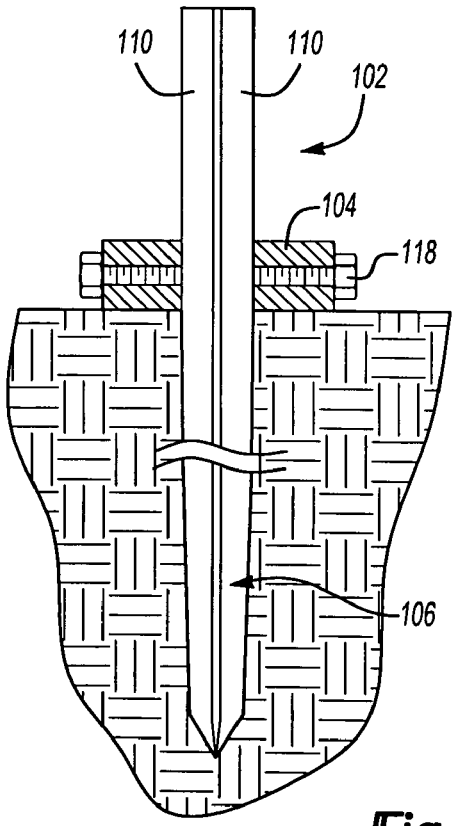
FIG. 13 is a side view of the anchor constructed in accordance with the alternative embodiment.

Referring now to FIGS. 11-13, the anchor 102 of the alternative embodiment includes a body having a spike portion 106, a pole support portion 108 and a generally cross or "X" shape such that the anchor 102 includes four longitudinally extending flange portions 110. The end 112 of the support portion 108 of the anchor 102 is flat, which assists a user in striking the anchor 102 with a hammer or like device (not shown).

The base member 104 preferably includes a cross or "X" shaped aperture 114 and is slidably engageable with the flange portions 110 of the anchor 102.

At least one borehole 116 is disposed in the side of the base member 104 that extends through the base member 104 to the "X" shaped aperture 114. The base member is removably secured to the anchor 102 by the use of a bolt 118 that threadably engages the borehole 118. Therefore, it will be appreciated that a user may adjust the position of the base member 104 on the anchor 102 in order to avoid driving the spike portion 106 of the anchor 102 too far into the ground. It will also be appreciated that the base member 104 of the anchor 102 of the alternative embodiment may be manufactured as an integral part of the anchor 102. Furthermore, as will shown and discussed below (see e.g., FIG. 14), when the fencing material 18 of the fence system is partially buried, it is often necessary to dig a trench for the fencing material 18 after the pole(s) 104 are in place. Accordingly, it can be understood that a base member(s) 104 that is secured along the length of an anchor 102 (which preferably has a spike 106 that extends into the ground deeper than the trench) will maintain the pole 14 at a level position or height despite the fact that a user may be digging the trench in close proximity to the pole 14 and anchor 102.

Figure 14:
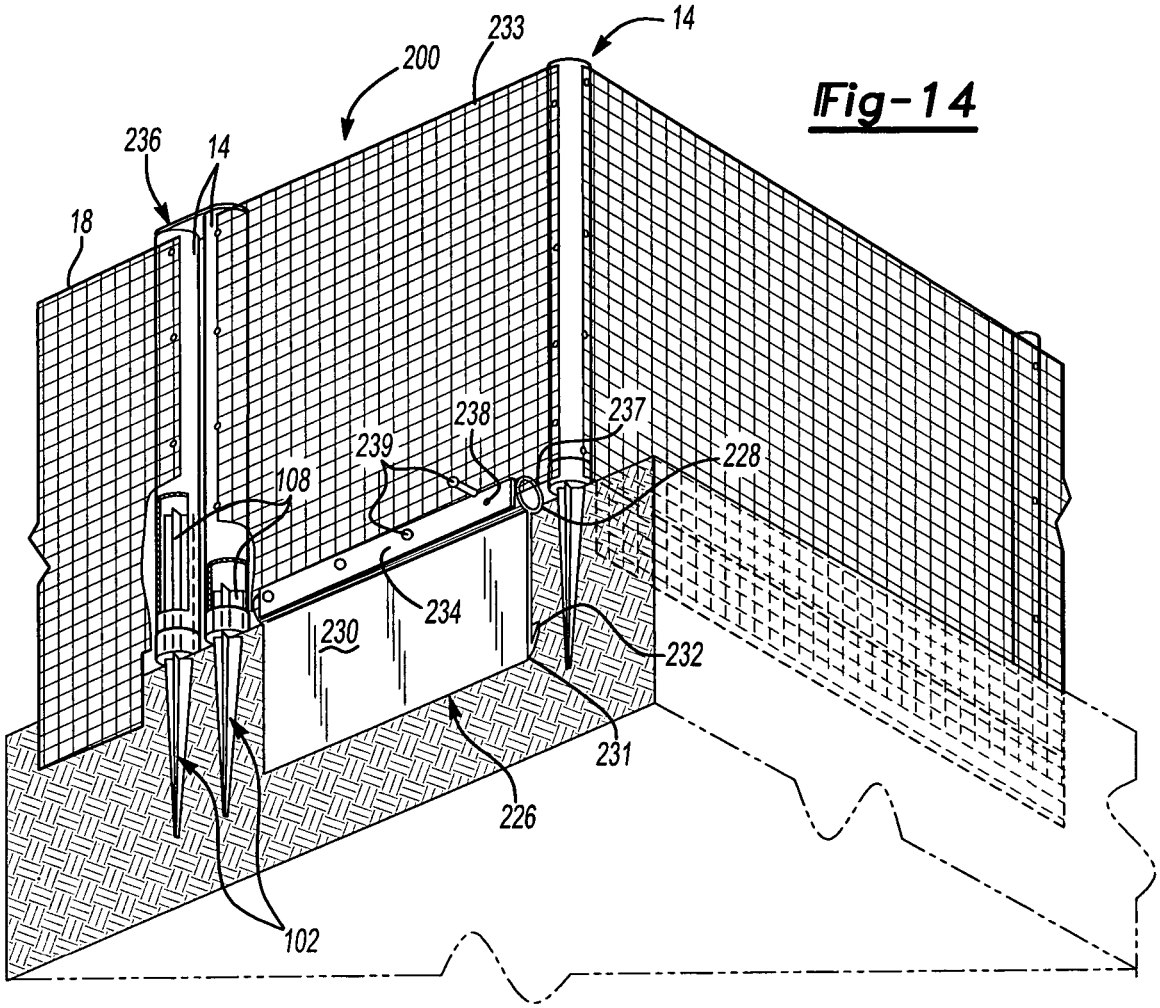
FIG. 14 is a perspective view of a fencing system from below ground level including an alternative gate assembly.
Figure 15:
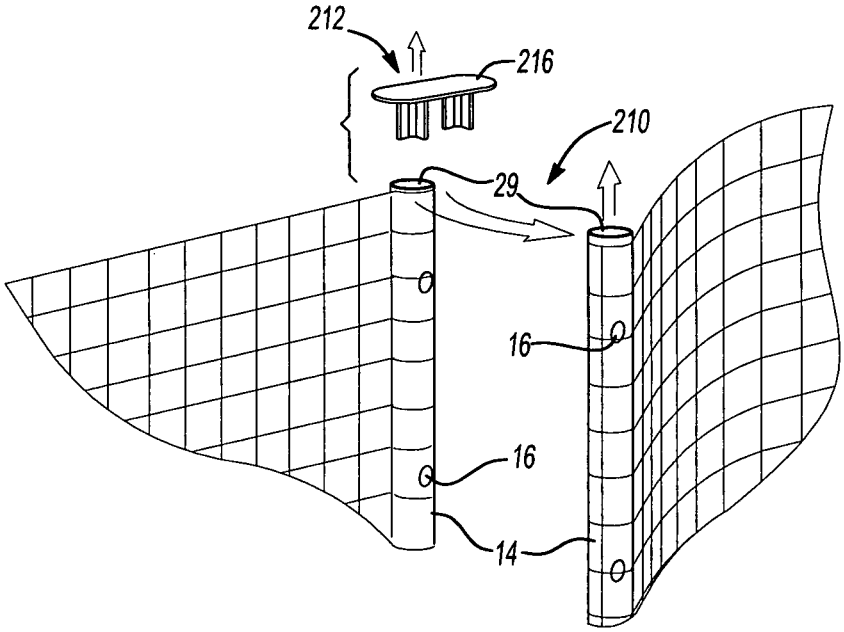
FIG. 15 is a cutaway partial perspective view of the gate assembly of FIG. 14.
Figure 16:
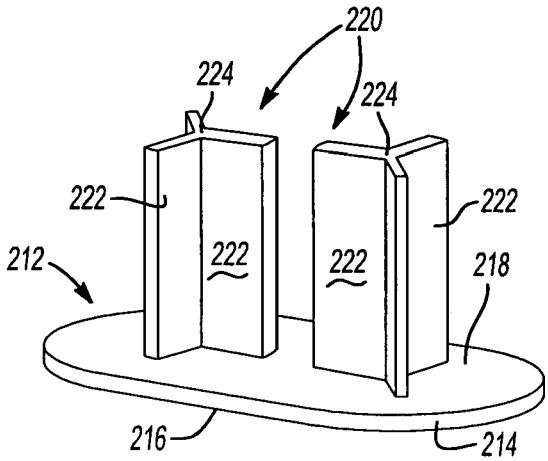
FIG. 16 is a perspective view of a connector lock for use with the gate assembly of FIG. 4.

Referring now to FIGS. 14-16, there is shown a second alternative embodiment of a fencing system 200. The fencing system 200 is constructed substantially similar to that of the other above-described embodiments in that it includes an anchor 102 (or anchor 12) having an adjustable base member 104. A pole 14 is mounted over and supported on the anchor 102 and is seated on the base member 104. A fastener 16 is positioned on the pole 14 and is used for securing fencing material 18.

Still referring to FIGS. 14-16, but as best shown in FIG. 15, a gate assembly 210 is provided to allow a user with a quick and easy system for entering and exiting an area enclosed by the fencing system 200. The gate assembly 210 includes a connector lock 212 that has a cap portion 214 that has a first 216 and a second 218 side. A pair of engagement members 220 extends from the second side 218 of the cap portion 214 and includes flange members 222 that extend radially outward from a center axis 224. Each flange member 222 has a predetermined length (radius) such that the engagement members 220 have a snug fit with the interior of the open end 29 of a pole 14.

Referring now to FIG. 14, the gate assembly 210 may also include barrier 226 for blocking of burrowing or digging animals. The barrier 226 has a tubular body 228 having a series of boreholes (not shown). A flange 230 extends from the body 228 and an end 231 of the flange 230 opposite the body 228 is bent back onto itself to form a hook 232. The flange 230 will preferably extend from the body 228 a length between one and eighteen inches, and the body 228 will have a length equal to or greater than the width of fence portion 233 of the gate assembly 210. A securing strip 234 (e.g., a thin strip of metal or plastic) having a plurality of holes 238 is provided to assist in removably attaching/sandwiching an end 237 of the fence portion 233 to the body 228.

As best shown in FIG. 14, the barrier 226 is buried in the ground proximate the gate assembly 210 such that the flange 230 is disposed below ground while the body 228 remains above ground. Once buried, the hook 232 of the flange 230 prevents the easy removal or relocation of the barrier 226. The end 237 of the fence portion 233 of the gate assembly 210 is then sandwiched between the body 228 and the securing strip 234. The strip 234 and body 228 are thereafter removably secured together by pins 239 that extend through the boreholes (not shown, 238) of the body 228 and the strip 234.

Referring now to FIGS. 14 and 15, the connector lock 212 is removably mounted to a pair of closely spaced poles 14 (i.e. a movable gate pole and a second pole). The engagement members 222 of the connector lock 212 are removably mounted in the open ends 29 of the two closely spaced poles 14 such that the two poles 14 are secured together. In FIG. 14 it can be seen that each pole 14 of the pair of closely spaced poles are supported by the pole support portion 108 of an anchor 102. However, the pole support portion 108 for the pole 14 of the gate assembly 210 is shorter such that the pole 14 may be easily lifted off the support portion 108 (to permit entry into the enclosed area) following the removal of the connector lock 212 and the disconnecting of the barrier 226.

Figure 17:
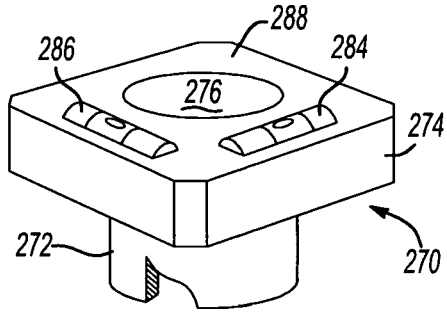
FIG. 17 is a perspective view of a pole level for use with the fencing system of the present invention.
Figure 18:
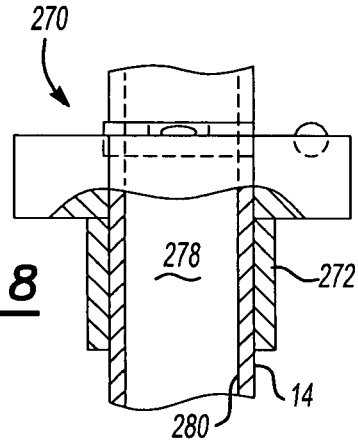
FIG. 18 is a side partial cutaway view of the pole level of FIG. 17.

Referring now to FIGS. 17 and 18, there is shown a pole level 270 for use in connection with the poles 14 or anchors 12, 102 of the present invention. The pole level 270 includes a sleeve 272 and a plate 274 that is mounted on one end of the sleeve 272 perpendicular to a longitudinal axis of the sleeve 272. An opening 276 is provided in the plate 274 and is aligned with an opening 278 defined by the interior 280 the sleeve 282. A first 284 and a second 286 bubble level are positioned at an orientation perpendicular to each other on a top surface 288 of the plate 274.

As best shown in FIG. 18, in operation the pole level 270 is slidably disposed around a pole 14. Once in position, a user will observe the first and second bubble levels 284, 286 to manually adjust the position of the pole to ensure that the pole 14 is vertical. Additionally, it will also be appreciated that the pole 14 level may also be used in connection with an anchor 12, 102 in a fashion similar to the pole 14 to ensure that the anchor 12, 102 is vertical prior to the placement of the pole 14 on the anchor 12, 102.

Figure 19:
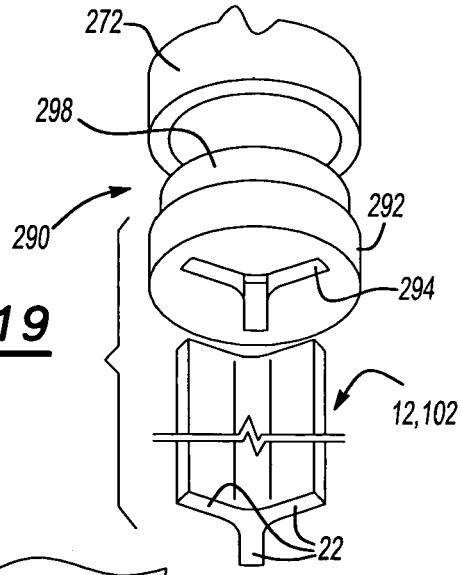
FIG. 19 is a perspective view of an anvil for use with an anchor of the present invention.
Figure 20:
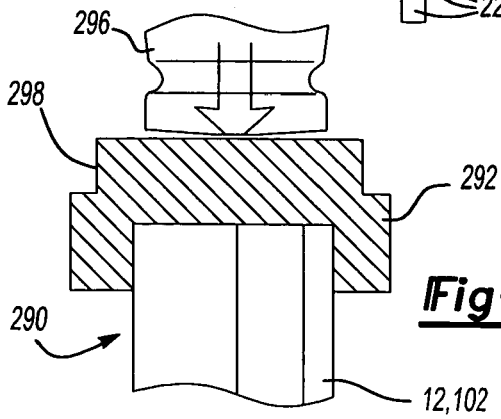
FIG. 20 is a side cutaway view of the anvil of FIG. 19.

Referring now to FIGS. 19 and 20, there is shown a mallet 290 for use in hammering or otherwise forcedly embedding an anchor 12, 102 into the ground. As best shown in FIG. 19, the mallet 290 includes a body 292 having a number of grooves 294 complementary to the flange portions 22 of the anchor 12, 102. Accordingly, the mallet 290 is positionable over an end of the anchor 12, 102 and is adapted to be struck by a hammer 296 or other object to aide in the driving of the anchor 12, 102 into the ground. A step 298 is provided around the body 292 of the mallet 290 so that the sleeve 272 of the pole level 270 may be disposed around and support by the body 292 (see FIG. 19).

Figure 21:
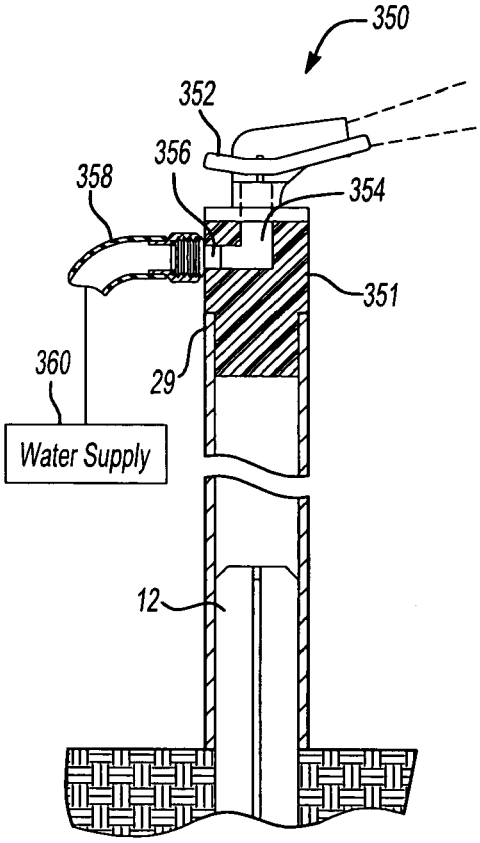
FIG. 21 is a side cutaway view of a sprinkler assembly for use with the fencing system of the present invention.

Referring now to FIG. 21, there is shown a sprinkler assembly 350 for use with a pole 14 of the fencing system 10, 100, 200 of the present invention. The sprinkler assembly 350 includes a base 351 that is shaped to fit on, around or in the end of a pole 14. A sprinkler 352 is positioned on top of the base 351 at one end 29 of a pole 14. A fitting 356 for a hose 358 (or the like that is connected to a fluid (i.e., water) supply source 360) is positioned along the side of the base 351. A conduit 354 extends from the fitting 356 through the base 351 to the sprinkler 352 to communicate the fluid (i.e., water) from the fitting to the sprinkler 352.

Use of the sprinkler assembly 350 provides a user with an easy means for watering the area enclosed by the fencing system 10, 100, 200 without having to open or close a gate or otherwise set up a separate sprinkler system in or near the enclosed area.

While the present invention has been described as carried out in specific embodiments thereof, it is not intended to be limited thereby but is intended to cover the invention broadly within the scope and spirit of the appended claims.

I claim:

1. A fence system comprising:

an anchor that is insertable into the ground;

a pole having a first and a second open end, the second open end being mounted over the anchor such that the pole is supported by the anchor;

a fastener located on the pole;

a fencing material that is secured to the pole by the fastener;

a pole level comprising a sleeve; and a mallet operable to engage the anchor for assisting with the embedding of the anchor into the ground, the mallet including a step having a shape complimentary to and being engagable by the sleeve of the pole level.

2. The fence system of claim 1, wherein the pole level further comprises, a plate secured to the sleeve and a first and second bubble level positioned on the plate.

3. The fence system of claim 2, wherein the sleeve of the pole level comprises a tubular shaped wall, the wall having a longitudinal axis, a pair of open ends and an interior surface, and the plate is secured on one of the open ends of the sleeve, perpendicular to the longitudinal axis and comprises an opening that is aligned with the open end of the sleeve to which the plate is secured.

4. The fence system of claim 1, wherein the anchor further comprises a plurality of flanges and the mallet further comprises a body having a plurality of grooves that are complementary to the flanges of the anchor such that the mallet is positionable on the anchor.

5. The fence system of claim 1, comprising a baffler operable to be secured to the fencing material.

6. The fence system of claim 1, further comprising a sprinkler assembly removably mounted on the pole.

7. The fence system of claim 6, wherein the sprinkler assembly includes a base and a sprinkler positioned on the base, the base being operable to be removably mounted on the first open end of the pole.

8. A fence system comprising:

a plurality of anchors that are insertable into the ground;

a plurality of poles, each pole having an first and second open end, the second open end of each pole being mounted over one anchor of the plurality of anchors such that an anchor supports each pole;

a gate assembly, the gate assembly including a gate pole having a first and second open end;

a fencing material that is secured to the plurality of poles and the gate assembly;

a connector lock removably mounted on a first open end of the gate pole and the first end of one pole of the plurality of poles;

a pole level comprising a sleeve; and a mallet operable to engage an anchor for assisting with die embedding of the anchor into the ground, the mallet including a step having a shape complimentary to and being engagable by the sleeve of the pole level.

9. The fence system of claim 8, wherein the pole level comprises a plate secured to the sleeve and a first and second bubble level positioned on the plate.

10. The fence system of claim 9, wherein the sleeve of the pole level comprises a tubular shaped wall, the wall having a longitudinal axis, a pair of open ends and an interior surface, and the plate is secured on one of the open ends of the sleeve, perpendicular to the longitudinal axis and comprises an opening that is aligned with the open end of the sleeve to which the plate is secured.

11. The fence system of claim 8, wherein each anchor of the plurality of anchors further comprises a plurality of flanges and the mallet further comprises a body having a plurality of grooves that are complementary to the flanges of an anchor such that the mallet is positionable on an anchor.

12. The fence system of claim 8, wherein each pole of the plurality of poles comprises a plastic tubular pole.

13. The fence system of claim 8, wherein each pole of the plurality of poles comprises an aluminum tubular pole.

14. The fence system of claim 8, wherein each anchor of the plurality anchors comprises a polymeric material.

15. The fence system of claim 8, wherein each anchor of die plurality of anchors comprises aluminum.

16. The fence system of claim 8, further comprising a plurality of fasteners, the fasteners being operable to secure the fencing material to the poles and gate pole.

17. The fence system of claim 8, wherein the fencing material comprises a polymeric mesh material,

18. The fence system of claim 8, wherein the fencing material comprises a metal wire fencing.

19. The fence system of claim 8, wherein each anchor of the plurality of anchors comprises a stake portion and a pole support portion.

20. The fence system of claim 19, wherein each anchor of the plurality of anchors comprises a base member.

21. The fence system of claim 8, comprising a barrier operable to be secured to the fencing material.

22. The fence system of claim 8, farther comprising a sprinkler assembly removably mounted on one pole of the plurality of poles.

23. The fence system of claim 22, wherein the sprinkler assembly includes a base and a sprinkler positioned on the base, the base being operable to be removably mounted on die first open end of a pole.

* * * * *

UNITED STATES PATENT AND TRADEMARK OFFICE

CERTIFICATE OF CORRECTION

PATENT NO. : 7,500,654 B2
APPLICATION NO. : 10/839085
DATED : March 10, 2009
INVENTOR(S) : Lars Rosaen It is certified that error appears in the above-identified patent and that said Letters Patent is hereby corrected as shown below:

Column 7, line 22, replace “baffler” with --barrier--

Column 7, line 44, replace “die” with --the--

Column 8, line 23, replace “die” with --the--

Column 8, line 39, replace “farther” with --further--

Column 8, line 44, replace “die” with --the--

Signed and Sealed this

Seventh Day of July, 2009

JOHN DOLL
*Acting Director of the United States Patent and Trademark Office*